United States Patent [19]

Hanson

[11] 4,120,092

[45] Oct. 17, 1978

[54] PLASTIC INJECTION MOLDED BOW COMPASS

[76] Inventor: Goodwin F. Hanson, 4640 W. 118th St., Hawthorne, Calif. 90205

[21] Appl. No.: 786,516

[22] Filed: Apr. 11, 1977

[51] Int. Cl.[2] ..... B43L 9/22

[52] U.S. Cl. ..... 33/27 B; 33/154 C

[58] Field of Search ..... 33/27 B, 149 R, 153 R, 33/153 D, 154, 155

[56] References Cited

U.S. PATENT DOCUMENTS

| | | | |
|---|---|---|---|
| 364,561 | 6/1887 | Wilkinson | 33/155 |
| 1,260,916 | 3/1918 | Kuhne | 33/153 D |
| 2,253,569 | 8/1941 | Langsner | 33/156 R |
| 2,637,113 | 5/1953 | Kroenlein | 33/27 BX |
| 3,208,149 | 9/1965 | Zachs | 33/27 B X |

FOREIGN PATENT DOCUMENTS

| | | | |
|---|---|---|---|
| 149,318 | 4/1937 | Austria | 33/153 D |

*Primary Examiner*—Charles E. Phillips

*Attorney, Agent, or Firm*—Albert M. Herzig; Edward C. Walsh

[57] ABSTRACT

A bow compass, the parts of which are formed by a plastic injection molding process. The compass is provided with a fine adjustment by threaded means and also a quick adjusting coarse adjustment. The compass minimizes screw threading operations, there being a threaded barrel nut which like the other parts is formed by plastic injection molding.

3 Claims, 8 Drawing Figures

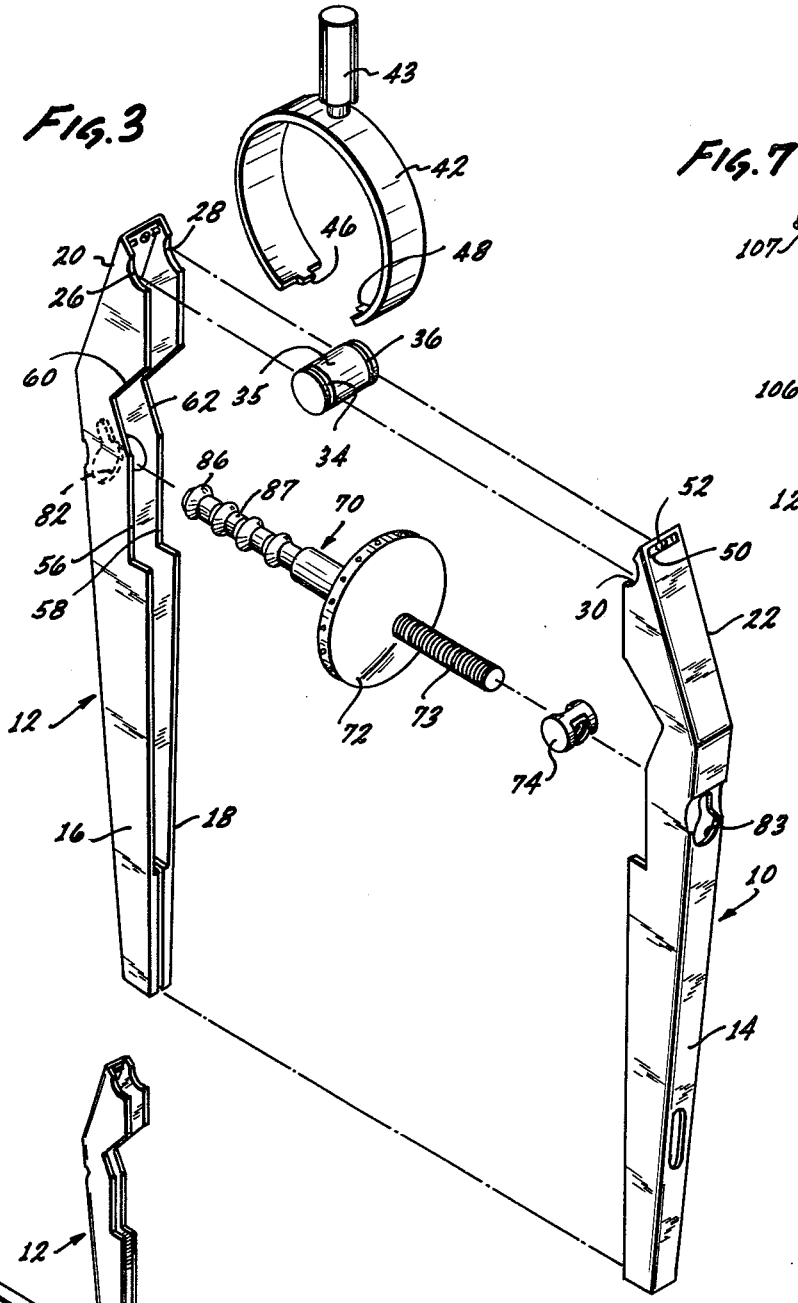
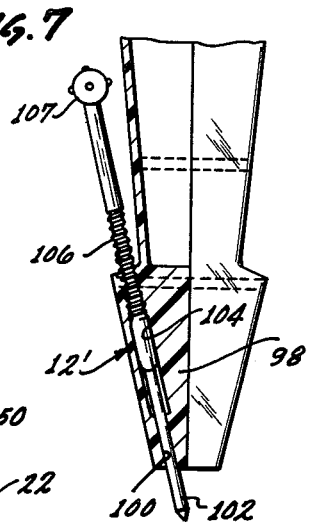
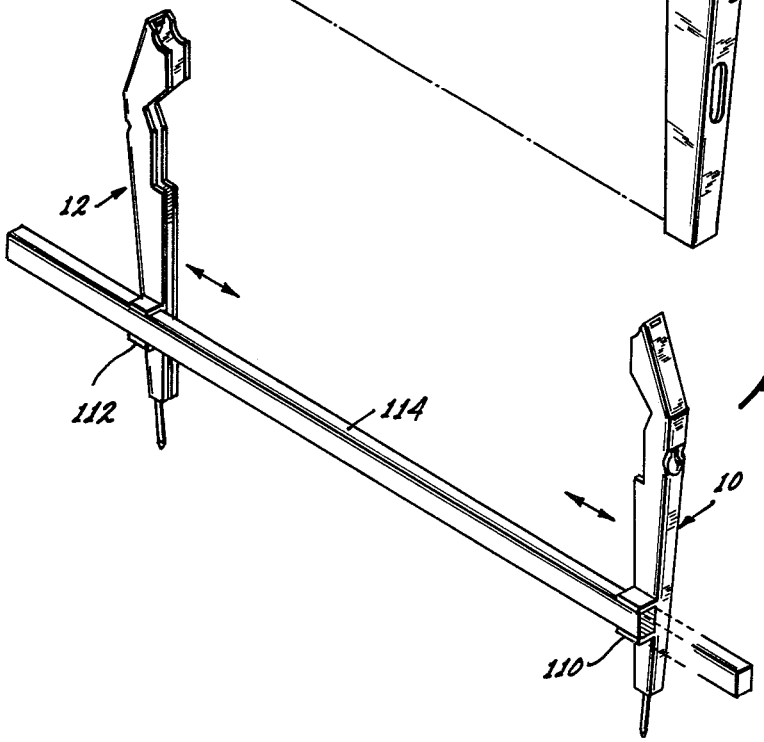
FIG. 8

PLASTIC INJECTION MOLDED BOW COMPASS

BACKGROUND OF THE INVENTION

1. Field of the Invention

The field of the invention is that of bow compasses and dividers.

2. Description of the Prior Art

In general, the prior art identifying bow compasses resides in the following patents: No. 2,637,113; 3,208,149; 3,280,466; 3,584,384; 3,662,468; 3,745,662; and 3,768,166.

Bow compasses as such are, of course, well known in the art. The known prior art is, however, lacking in particular distinctive features embodied in the compass of the herein invention as described and explained in detail hereinafter. Particularly, the prior art lacks the quick acting coarse adjustment and a type of design and construction adapting the article to fabrication by a plastic injection molding process.

SUMMARY OF THE INVENTION

The compass of the invention is so designed that its various parts can be fabricated and produced by an injection molding process. A particular feature of the compass is that it provides a screw threaded fine adjustment and a quick acting coarse adjustment as well. The coarse adjustment is, of course, highly desirable since it facilitates quickly changing the setting of the compass between small and large diameters and vice versa.

The design of the invention which makes it possible to fabricate it using injection molding processes is such that the number of threading operations as are ordinarily found in compasses is reduced or minimized. The compass of the invention is provided with an adjusting stem, one end of which is threaded and which threads through a barrel nut positioned in one leg of the compass so as to allow angular tilting of the adjusting stem. The barrel nut itself is made in halves so it too can be made by an injection molding process. The adjusting stem passes through a hole or opening in one leg of the compass so configurated that by tilting the stem, large or coarse adjustments in the compass can be easily and quickly made.

In light of the foregoing, a primary object of the present invention is to make possible an improved bow compass having both a fine and a coarse adjustment.

Another object is to realize a compass as in the foregoing wherein all parts of the compass can be fabricated using an injection molding process.

Another object is to realize a compass as in the foregoing wherein the compass has an adjusting stem, one end of which is threaded and passes through a barrel nut mounted in one leg of the compass, the other end of the adjusting stem passing through an opening in the other leg of the compass of particular configuration which allows angular tilting of the adjusting stem for purposes of making coarse adjustments.

BRIEF DESCRIPTION OF THE DRAWINGS

FIG. 3 is an exploded view of the compass of FIGS. 1 and 2;

FIG. 7 is an enlarged detailed view of the end of one leg of a modified form of the compass.

DESCRIPTION OF THE PREFERRED EMBODIMENTS

Figure 1:
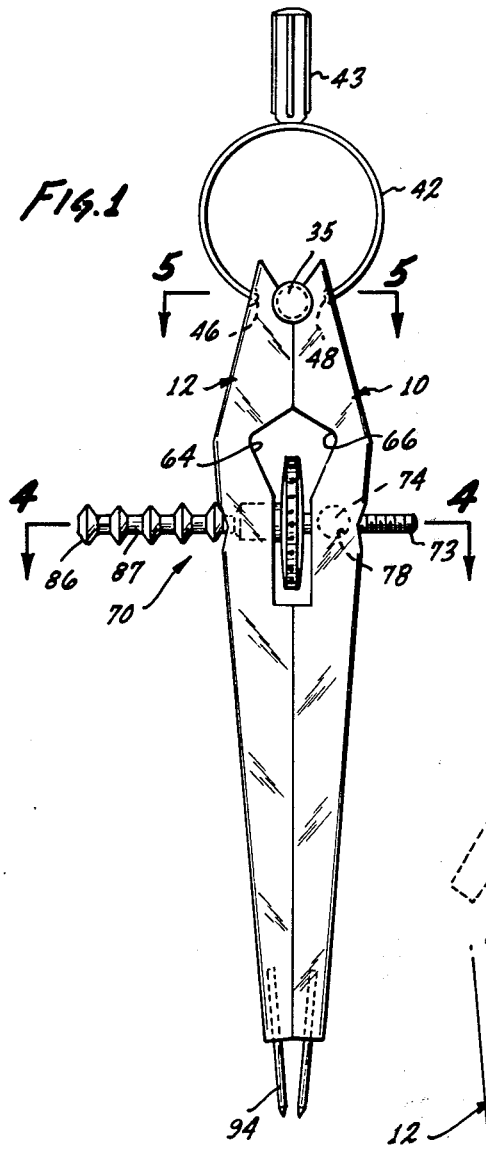
FIG. 1 is a front view of a preferred form of the invention.

Referring now in detail to FIGS. 1–6, the compass is shown having leg members 10 and 12. The configuration of the legs may best be seen in FIG. 3. As may be observed, the leg 12 is of channel section which facilitates its fabrication by the injection molding process. The back wall of the channel section forming the leg 10 is designated at 14. The sides of the channel section forming the leg 12 are designated at 16 and 18. The upper end of the leg 12 has an inward taper as designated at 20 and the upper end of the leg 10 has an inward taper as designated at 22. Formed in the ends of the sidewalls 16 and 18 near the top are arcuate cutouts 26 and 28 and similar arcuate cutouts are formed at the top end of the leg 10, one of them being designated at 30.

Numeral 34 designates a pivot pin having grooves 35 and 36 at its ends. When the legs are assembled, the arcuate cutouts as described on the inside of the upper ends of the legs, fit into the grooves 35 and 36 in the pivot 34, the assembled relationship being shown in FIGS. 1 and 2.

Figure 2:
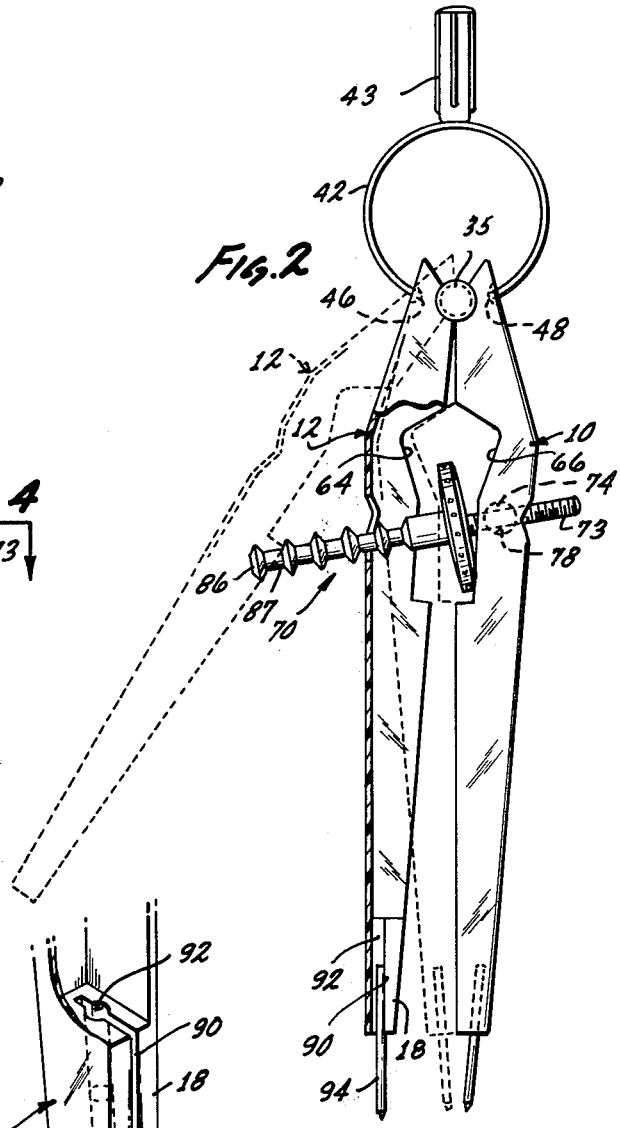
FIG. 2 is a view similar to that in FIG. 1 partly broken away to illustrate the coarse adjustment feature.

The legs of the compass are normally held in an assembled relationship by a circular split spring member 42 which has extending from it a handle or fingerpiece 43. At the ends of the spring member 42, there are extending tabs as shown at 46 and 48. The outside of the upper ends of the legs 10 and 12 have transverse slots as designated at 50 for the leg 10 and at an intermediate point of the slot 50 there is an opening 52 in position to receive the tab on the spring 42. The ends of the spring 42 are thus similarly received in the slots and openings at the upper ends of the legs 10 and 12 so that the legs are held in position as illustrated in FIGS. 1 and 2.

As may be seen in FIG. 3, the sidewalls 16 and 18 of the leg 12 are cut back as shown at 56 and 58, the sidewalls of the leg 10 being similarly cut back so that the two legs are symmetrical. Above the cutouts or cut back areas, there are formed angular notches 60 and 62 in the sidewalls 16 and 18 of the leg 12, the sidewalls of the leg 10 having similar notches. When the legs are held by the spring 42 and in their closed position, the cutback areas as described provide openings as designated at 64 and 66 in FIG. 1.

The compass provides a fine adjustment and a coarse adjustment. Numeral 70 designates the adjusting stem on which is adjusting wheel 72. One end of this stem is threaded as designated at 73 and it passes through a barrel nut 74. The barrel nut is formed by a plastic injection molding process, it being formed in two halves and then fitted together so as to provide a threaded bore through the nut through which this threaded stem 73 extends. The barrel nut 74 is rotatedly mounted in sockets formed in the sidewalls of the leg 10, these sockets or recesses being designated at 78 and 79 in FIG. 4.

The back wall of the channel section of the leg 12 has a keyhold type slot in it, 82, and the leg 10 may have a similar slot 83. The left end of the adjusting stem 70 has on it a plurality of integral enlarged disc memmbers as designated at 86, the part of the stem between these members being of smaller diameter as designated at 7. The keyhole slots 82 and 83 have a larger part of a size which the disc 82 can pass through and an upper part of smaller size which the part 87 of the stem 70 of smaller diameter can fit into.

When the stem 70 is in a horizontal position as illustrated in FIG. 1, the part of the stem 70 of smaller diameter as designated at 87, fits into the smaller part of the keyhole slot. The fine adjustment is made simply by turning the wheel or knob 72 with the thumb which rotates the threaded stem 73 in the barrel nut 74 to move the two legs 10 and 12 towards or away from each other.

The coarse adjustment is provided by way of the stem 70. Barrel nut 74 is rotatable in its mountings so that the stem 70 can be tilted as illustrated in FIG. 2 and then the legs 10 and 12 can be moved towards or away from each other in large increments, the discs 86 on the stem 70 passing through the large part of the keyhole slot 82. When the coarse adjustment has been made the stem 70 is moved back into its horizontal position as shown in FIG. 1 with the part of stem 70 of smaller diameter fitting the smaller part of the keyhold slot 80. Tilting of the stem 70 is permitted by reason of the freedom of rotation of the barrel nut 74.

Figure 6:
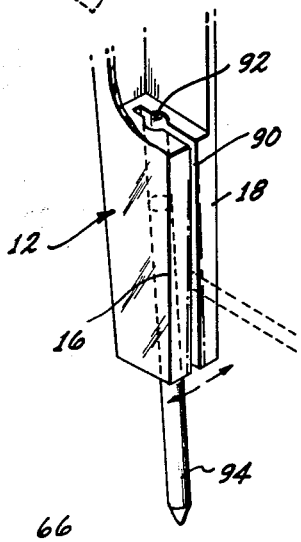
FIG. 6 is an enlarged detailed view of the end of one leg of the compass.
Figure 4:
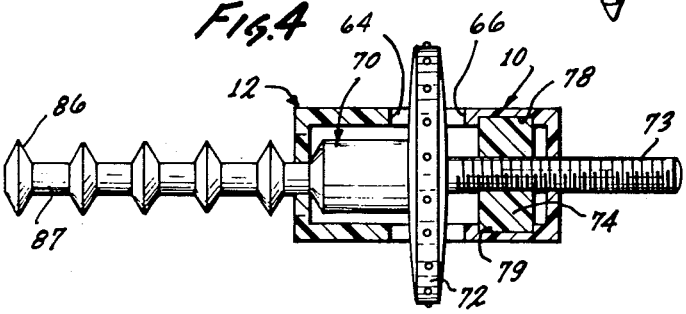
FIG. 4 is a section view taken along the line 4—4 of FIG. 1.
Figure 5:
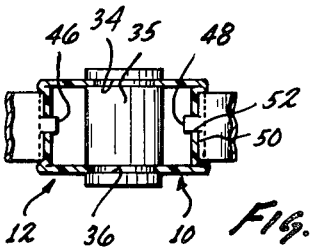
FIG. 5 is a section view taken along the line 5—5 of FIG. 1.

FIG. 6 illustrates the lower end of the leg 12. The lower end is solid but slotted as designated at 90. The lower part also has a bore as shown at 92 to receive the metal point as designated at 94. The slotted portion can be separated for insertion or removal of a point or a lead simply by insertion of a paper clip or other similar member.

FIG. 7 illustrates a modified form of construction wherein the one leg is designated by the numeral 12'. The lower end of the leg is solid, as designated at 98 having a bore in its lower part as designated at 100 to receive a steel point 102. Numeral 104 designates a larger bore which receives a threaded adjusting stem 106 having a knob 107 at its end.

The nature of the design and construction of the compass is such that it can be readily converted into a beam compass. This is illustrated in FIG. 8. The stem 70 is disconnected from the legs and removed. The legs are allowed to spread apart and the spring 42 is removed so that the legs are entirely separate. Then mounted on the legs 10 and 12 are clips or riders 110 and 112 which can slip onto a beam 114 made of wood, plastic or other material. In this manner, the legs can be slid along the beam so that a beam compass is realized.

From the foregoing, those skilled in the art will readily understand the nature and construction of the invention and the manner in which it achieves and realizes all of the objects as set forth in the foregoing as well as the many advantages that are apparent from the detailed description.

The foregoing disclosure is representative of preferred forms of the invention and is to be interpreted in an illustrative rather than a limiting sense, the invention to be accorded the full scope of the claims appended hereto.

What is claimed is:

1. A compass or divider comprising first and second leg members having a pivotal relationship to each other, a stem extending between the leg members providing for angular adjustment of said leg members toward and away from each other, said stem having threaded means at one end, said first leg member having threaded means rotatably mounted thereon, said threaded end of said stem being threadly engaged in said threaded means to allow pivoting of said stem about the rotation axis of said threaded means, said second leg being provided with a keyhole shaped opening having a larger part and a smaller part, the other end of said stem having a diameter which will fit into the smaller part of said opening and having spaced parts of a larger diameter to fit into said larger part of said opening, said stem being pivoted with said threaded means with respect to said first leg and directly connected to said second leg via said opening and said larger diameter parts for coarse adjustment of said first leg with respect to said second leg and said stem is rotated about its axis for fine adjustment via said threaded engagement.

2. A compass as in claim 1 wherein said spaced parts of a larger diameter being enlargements of said stem.

3. A compass as in claim 2 wherein the threaded means include a nut mounted in the first leg in a manner to allow angular movement thereof and to accommodate angular movement of the said stem.

* * * * *